United States Patent [19]

Moore et al.

[11] 4,261,472

[45] Apr. 14, 1981

[54] RAILWAY COUPLER WEAR MEMBER

[75] Inventors: William F. Moore, Villa Park, Ill.; Donald L. Kleykamp, Springboro, Ohio; Julien C. Mathieu, Waynesville, N.C.

[73] Assignee: Dayco Corporation, Dayton, Ohio

[21] Appl. No.: 79,299

[22] Filed: Sep. 26, 1979

[51] Int. Cl.[3] ..... B61G 5/00; B61G 9/20; F16C 27/02

[52] U.S. Cl. ..... 213/61; 105/225; 105/420; 213/21; 213/51; 308/3 R; 308/238; 308/244

[58] Field of Search ..... 213/50, 51, 54, 58, 213/59, 60, 61, 62, 63, 21; 105/225, 199 C, 420; 308/3 R, 237, 238, 244

[56] References Cited

U.S. PATENT DOCUMENTS

| | | | |
|---|---|---|---|
| 3,897,736 | 8/1975 | Tack | 105/225 |
| 4,133,434 | 1/1979 | Chierici | 213/61 |
| 4,170,180 | 10/1979 | Houston | 308/238 X |
| 4,192,240 | 3/1980 | Korpics | 105/225 |
| 4,238,039 | 12/1980 | Cooper | 213/61 |

*Primary Examiner*—David M. Mitchell
*Assistant Examiner*—Howard Beltran
*Attorney, Agent, or Firm*—Charles E. Bricker

[57] ABSTRACT

A railway vehicle wear member is provided between a pair of relatively movable components of the railway vehicle, wherein such wear member has a rigid planar supporting portion used to support a polymeric antifriction wear material and an extension which comprises the planar supporting portion and is formed in position against one of the relatively movable components to hold the wear member against a particular movement relative to the one component.

9 Claims, 6 Drawing Figures

RAILWAY COUPLER WEAR MEMBER

BACKGROUND OF THE INVENTION

1. Field of the Invention

This invention relates to a railway vehicle wear member and method of installing same between a pair of relatively movable components of such railway vehicle.

2. Prior Art Statement

It is known in the art to provide a railway vehicle wear member for a pair of relatively movable components of such vehicle wherein such wear member comprises a metal support having a continuous planar supporting surface, antifriction polymeric material, and means attaching the polymeric material to the support and supporting same against the continuous supporting surface for the purpose of providing a substantially structurally self-supporting wear member. Such a wear member is generally provided with holding legs or brackets fixed to the metal support for the purpose of holding the wear member in position on one of the pair of relatively movable components. The present practice is to provide brackets or legs on the metal support of the wear member during manufacture and prior to shipment thereof to a user whereby such wear member may only be installed in position when a pair of relatively movable components sought to be protected are apart in a new installation or are first taken apart in a wear member replacement situation. An example of a wear member of this type has been proposed in United States patent application Ser. No. 27,340, filed Apr. 5, 1979, now U.S. Pat. No. 4,238,039, issued Dec. 9, 1980. However, a wear member of this type adds to the total maintenance costs when used as a replacement part during maintenance and is thus not desirable for this type of use.

SUMMARY

It is a feature of this invention to provide a wear member for use between a pair of relatively movable components of a railway vehicle which may be easily installed in position without disassembly of the relatively movable components and after removal of the wear member which it replaces.

Another feature of this invention is to provide a wear member of the character mentioned which comprises a support having a planar supporting portion, a polymeric material having an antifriction wear surface, and means attaching the polymeric material against the planar supporting portion with the planar supporting portion having an extension which extends coplanar with the planar supporting portion and which is adapted to be finally formed transverse the planar supporting portion and against an associated one of the relatively movable components to hold the wear member against a particular movement relative to the one component.

Another feature of this invention is to provide a wear member of the character mentioned in which the extension is comprised of a plurality of cooperating holding fingers which may be individually formed in position to facilitate the forming action.

Another feature of this invention is to provide a wear member of the character mentioned in which the forming action may be achieved without disassembly of the pair of relatively movable components between which the wear member is installed and the forming action is a bending action.

Another feature of this invention is to provide a wear member of the character mentioned in the form of a coupler carrier wear member.

Another feature of this invention is to provide a method of installing a wear member of the character mentioned.

Another feature of this invention is to provide a method of protecting a pair of relatively movable components of a railway vehicle against excessive wear during relative movement thereof employing a wear member of the character mentioned and an improved method of installing such wear member in position without disassembly of the relatively movable components.

Therefore, it is an object of this invention to provide an improved railway vehicle wear member and method having one or more of the novel features set forth above or hereinafter shown or described.

Other details, features, uses, objects, and advantages of this invention will become apparent from the embodiment thereof presented in the following specification, claims, and drawing.

BRIEF DESCRIPTION OF THE DRAWING

The accompanying drawing shows a present preferred embodiment of this invention, in which.

DESCRIPTION OF ILLUSTRATED EMBODIMENT

Figure 1:
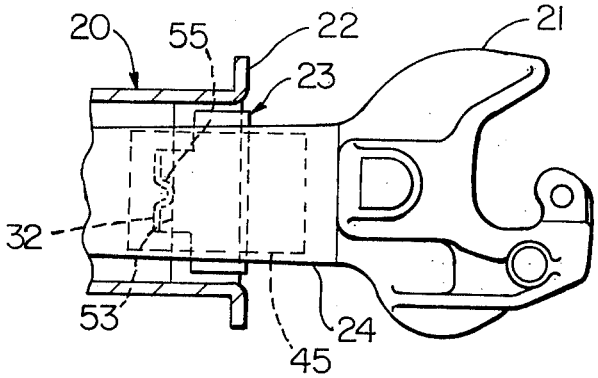
FIG. 1 is a fragmentary top plan view of an end portion of a railway freight car showing a coupler and a coupler carrier thereof and illustrating one exemplary embodiment of this invention in the form of a coupler carrier wear member disposed between such coupler and coupler carrier wherein such wear member comprises a metal support having an extension which has been formed in position and a liner made of an antifriction polymeric material attached to the metal support.

Reference is now made to FIG. 1 of the drawing which illustrates a fragmentary portion of an end of an exemplary railway vehicle 20 and such vehicle end has a coupler assembly or coupler 21 and a coupler carrier 22. As described in the above-mentioned copending United States patent application Ser. No. 27,340, and as is known in the art, the coupler assembly 21 and coupler carrier 22 are relatively movable and define the relatively movable components of the railway vehicle 20 which are described herein.

Figure 2:
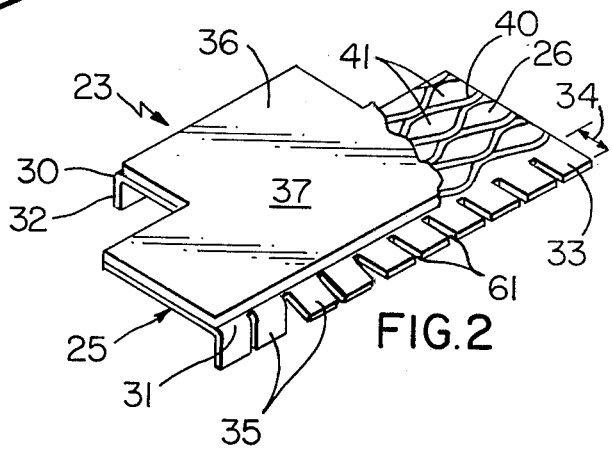
FIG. 2 is a perspective view with parts broken away of the exemplary wear member of FIG. 1 and showing the manner in which holding fingers comprising the extension thereof are formed in position to hold the wear member on the coupler carrier.

An exemplary embodiment of the wear member of this invention is provided and shown in perspective view in FIG. 2 and such wear member is designated generally by the reference numeral 23. The wear member 23 is supported by one of the components 21–22 and in this example of the invention, the wear member 23 is supported by the coupler carrier 22. The wear member 23 protects the components 21 and 22 and in particular the shank portion 24 of the coupler assembly 21 and the coupler carrier 22 from wear during relative movement thereof.

Figure 6:
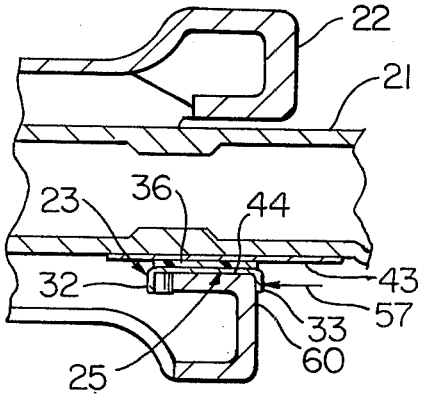
FIG. 6 is a view similar to FIG. 5 showing the coupler against the wear member now interposed between the wear surfaces and schematically illustrating the final forming of the extension.

Reference is now made to FIGS. 2 and 6 of the drawing for a more detailed presentation of the wear member 23. The wear member 23 comprises a rigid high-strength support which in this example is in the form of a metal support plate 25 which has a planar supporting portion 26 provided with a pair of opposite side edges consisting of an edge 30 at one extreme side thereof and an edge 31 at its opposite side. The wear member 23 also comprises a holding leg 32 which extends transverse, perpendicular in this example, to the side edge 30 and a basically planar extension, which is designated generally by the reference numeral 33, which extends coplanar to the planar supporting portion 26 and outwardly beyond the edge 31 by an extension length 34. The purpose of the extension 33 and the manner in which such extension is utilized comprise this invention and will be described in detail subsequently.

The extension 33 is preferably comprised of a plurality of fingers which will be referred to as holding fingers and each of such fingers is designated by the same reference numeral 35. The holding fingers 35 may be of any suitable configuration or of different configurations; however, such fingers 35 are basically identical and are of roughly rectangular peripheral outline.

The wear member 23 also comprises a polymeric material in the form of a polymeric matrix material 36 which has an antifriction outer wear surface 37 and means attaching the polymeric material to the support, i.e., against the planar supporting portion 26 of the support 25, and such attaching means is illustrated in FIG. 2 and comprises an expanded metal structure 40. The expanded metal structure 40 may be attached to planar supporting portion 26 utilizing any technique known in the art such as welding, mechanical fastening, or other suitable techniques.

The expanded metal structure 40 has openings 41 therein which receive the polymeric matrix material 36 completely therethrough whereby the openings 41 provide optimum embedment of the metal structure 40 whereby such structure 40 provides reinforcement for and prevents cold flow of the polymeric material 36; and, with the metal structure being welded or otherwise fixed against the planar supporting portion 26 of the support plate 25, it will be appreciated that polymeric matrix material 36 is thus firmly attached to the support 25.

Having described the detailed construction of the wear member 23 and presented a detailed description of a pair of typical components (the coupler assembly 21 and coupler carrier 22) between which such wear member may be used, the detailed description will now proceed with a description of the improved method of installing wear member 23 in position in accordance with the teachings of this invention. In particular, the wear member of this invention is particularly adapted to be installed during routine maintenance of the coupler assembly 21 and coupler carrier 22 with these two components 21–22 in assembled relation.

The coupler assembly 21 and coupler carrier 22 have wear surfaces 43 and 44 respectively which are disposed opposite each other and the wear member 23 of this invention is provided to prevent excessive wear of such surfaces 43 and 44, as is known in the art. In this example, the wear surface 43 of the coupler assembly 21 comprises the outside surface of a wear plate 45 which is suitably fixed to the coupler assembly 41, as by welding, or the like. The wear surface 44 comprises the outside surface of the basic metallic material of the coupler carrier 22. However, it will be appreciated that the wear surface 44 may also be provided as an outside surface of a special plate which may be fixed in position to the basic metallic structure of the coupler carrier so as to have an exposed surface thereof defining the wear surface 44.

Figure 3:
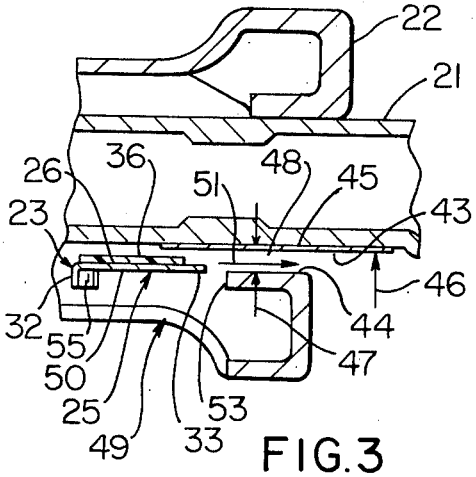
FIG. 3 is a fragmentary cross-sectional view showing a portion of the coupler carrier and coupler of FIG. 1 with such coupler carrier and coupler in assembled relation and with wear surfaces thereof held apart to facilitate installation of the wear member of this invention between such wear surfaces and illustrating the wear member at the commencement of the installing action.

As indicated earlier the wear member 23 has a planar extension 33 which extends from the planar supporting portion 26 and is disposed coplanar therewith. The wear member 23 is easily installed in position with the coupler assembly 21 and coupler carrier 22 basically in assembled relation as shown in FIG. 3 by disposing such wear member between the wear surfaces 43–44 while holding the wear surfaces 43 and 44 apart. This holding action is achieved with the coupler carrier 22 basically installed in its railway vehicle and merely by lifting vertically against the coupler assembly 21 utilizing a lifting device which is indicated schematically by an arrow 46 in FIG. 3. The lifting device 46 may be any suitable mechanical, pneumatic, or hydraulic device or jack. In addition, the lifting device 46 may comprise a lifting sling, or the like, associated with an overhead crane or lifting apparatus.

However, regardless of how the wear surfaces 43–44 are held apart, it will be appreciated that they are held apart a sufficient distance, indicated at 47 in FIG. 3, to enable easy insertion of the wear member 23 therebetween. In particular, the extension 33 is first extended between and through the volume 48 defined by lifting device 46 between the surfaces 43–44 followed by extending through such volume the planar supporting portion 26 of the wear member 23 with the polymeric material 36 attached thereon. The wear member 23 is inserted through an opening 49 in the coupler carrier 22 and inserted between the wear surfaces 43 and 44 so that the bottom surface 50 of the planar supportion portion 26 of the support 25 engages the wear surface 44 of the coupler carrier 22. With the wear member 23 in this position the antifriction surface 37 of the polymeric material 36 is particularly adapted to engage the wear surface 43 of the coupler assembly 21.

Figure 4:
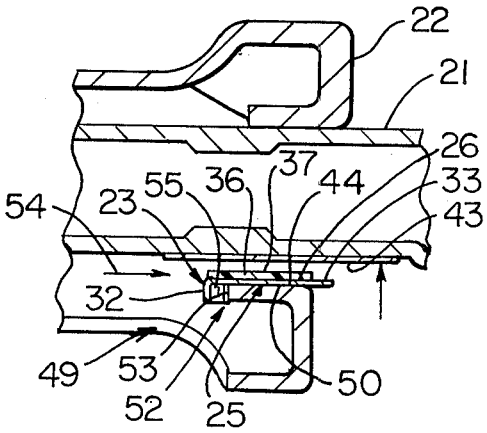
FIG. 4 is a view similar to FIG. 3 illustrating the wear member essentially in position between the coupler and the coupler carrier and prior to forming an extension portion of the metal support in position.

The step of inserting the wear member 23 in position is indicated schematically by the reference arrow 51 in FIG. 3 whereby the wear member 23 is inserted horizontally until the holding leg 32 thereof engages the coupler carrier as shown at 52 in FIG. 4 and thereby holds the wear member 23 against movement in one direction indicated by the arrow 54. In particular, the leg 32 holds the wear member 23 against an associated edge 53 of the coupler carrier 22 and prevents further movement horizontally in the direction 54. The holding leg 32 has a centrally disposed arcuate locating projection 55 thereon which engages a corresponding recess in the edge 53 and thereby centers and locates the wear member 23 while preventing movement thereof perpendicular to the direction 54.

Figure 5:
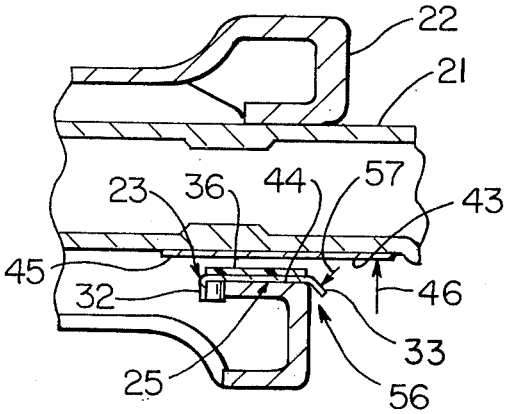
FIG. 5 is a view similar to FIG. 4 schematically showing the extension being formed in position.

Once the wear member 23 is inserted in position, in the manner illustrated in FIG. 4, the extension 33 is then formed transverse the planar supporting portion 26 and against the coupler carrier as shown at 56 in FIG. 5 and the forming action is achieved by bending the metal extension 33 employing a suitable bending mechanism which is shown schematically by an arrow 57. The initial bending action may be provided with the lifting device 46 still holding the coupler assembly 21 so that the wear surfaces 43 and 44 are apart. However, once the extension 33 has been partially formed or bent, the holding device 46 may be removed as illustrated in FIG. 6 thereby allowing the weight of the coupler assembly 21 to hold the wear member 23 against the surface 44 whereby the device 57 may be further employed to form the extension 33 against an associated exposed surface 60 of the coupler carrier 22.

The forming of the extension 33 is achieved with optimum simplicity inasmuch as such extension is comprised of a plurality of substantially identical holding fingers 35. Further, by utilizing a plurality of fingers 35 the side edge 31 of the planar supporting portion may be precisely defined and the wear member 23 locked in position with optimum simplicity. The fingers 35 may be defined employing any technique known in the art and one technique which may be employed is to define extension 33 as a single-piece extension having length 34 as previously described and providing a plurality of equally spaced apart cuts 61 in the extension 33 to define the fingers 35.

In this example, the fingers 35 are shown having substantially rectangular outlines. However, it is to be understood that such fingers may have other outlines, including trapezoidal, triangular, semicircular, and the like. p The support 25 comprising the wear member 23 of this invention is preferably in the form of a single-piece support having the holding leg 32 and the extension 34 with its integral fingers 35 defined as a single piece metal structure initially defined as a bendable high strength metal sheet or plate. However, it will be appreciated that the holding leg 32 need not necessarily be provided as part of the single-piece structure.

In this disclosure of the invention only one portion, i.e., extension 33, is shown as being formed in position on site and while maintaining the coupler 21 and coupler carrier 22 substantially assembled. However, it will be appreciated that the holding leg portion 32 may also be formed in position if desired, whereby the wear member 23 may be provided essentially in flat form. In this latter instance the holding leg 32 would be formed in position essentially as shown and described for the extension 33.

The wear member 23 of this invention is shown as comprised of a polymeric matrix material which is suitably fixed to support 25 utilizing expanded metal 40. However, it will be appreciated that the polymeric material with its antifriction surface 37 may be fixed in position utilizing any suitable technique known in the art.

The metal support 25 is preferably a metal plate or sheet of uniform thickness throughout and free of holes, apertures, or the like. In addition, the expanded metal structure 40 may be any grid-like structure, or the like, which is easily fastened to the metal support 25 for the purpose of attaching the polymeric material 36 and holding same against support 25 as well as reinforcing the polymeric matrix 36 and preventing cold flow thereof.

The polymeric material 36 may be any suitable material which provides an antifriction surface 37 which does not require conventional lubrication and is capable of being used between relatively movable components of a railway vehicle and preferably such polymeric material is an ultra high molecular weight polymeric material. The ultra high molecular weight material may have a molecular weight of at least 2 million and preferably has a molecular weight ranging between 4 to 6 million. In addition, the ultra high molecular weight polymeric material is preferably polyethylene and the preferred technique for determining such molecular weight is referred to in the art as the intrinsic viscosity test and is widely used in the United States.

In this disclosure of the invention the wear member 23 is in the form of a coupler carrier wear member. However, it will be appreciated that the concepts of this invention are fully applicable to wear members for other relatively movable components of railway vehicles.

While present exemplary embodiments of this invention, and methods of practicing the same, have been illustrated and described, it will be recognized that this invention may be otherwise variously embodied and practiced within the scope of the following claims.

What is claimed is:

1. In a wear member for a railway vehicle wherein said vehicle comprises a pair of relatively movable components and said wear member is supported by one of said components and protects said components from wear during relative movement thereof and said wear member comprises; a metal support having a planar supporting portion; a polymeric material having an antifriction wear surface engageable by said other component; and means attaching said polymeric material to said metal support and supporting same against said planar supporting portion; the improvement wherein said support has an integral holding portion initially extending coplanar with said planar portion and with said holding portion being adapted to be formed transverse said planar portion, said holding portion having been finally formed transverse said planar portion and against said one component with said relatively movable components substantially in assembled relation to hold said wear member against a particular movement relative to said one component.

2. A wear member as set forth in claim 1 in which said holding portion comprises a plurality of cooperating holding fingers.

3. In a coupler carrier wear member for a railway vehicle wherein said vehicle comprises a coupler assembly and a coupler carrier which are relatively movable and said coupler carrier wear member is supported by said coupler carrier and protects said coupler assembly and said coupler carrier from wear during relative movement thereof and said wear member comprises; a metal support having a planar supporting portion provided with a pair of opposite side edges and a holding leg extending perpendicular to one of said side edges, said holding leg being adapted to engage said coupler carrier to hold said wear member against movement in one direction; a polymeric material defining an antifriction wear surface engageable by said coupler assembly; and means attaching said polymeric material to said metal support and supporting same against said planar supporting portion while providing integral reinforcement for said polymeric material; the improvement comprising an extension initially extending from the other of said side edges coplanar with said planar supporting portion and with said extension being adapted to be formed transverse said planar supporting portion, said extension having been finally formed against said coupler carrier with said coupler assembly and coupler carrier substantially in assembled relation to hold said wear member against movement in a direction opposite from said one direction.

4. A wear member as set forth in claim 2 in which said extension comprises a plurality of fingers extending in parallel relation from said other side of said planar portion.

5. A wear member as set forth in claim 4 in which said fingers are substantially identical and each has a substantially rectangular outline.

6. A wear member as set forth in claim 4 in which said polymeric material comprises an ultra high molecular weight polyethylene.

7. A wear member as set forth in claim 4 in which said metal support is made of metal sheet with said holding leg, planar portion, and extension being defined as a single-piece structure.

8. In a wear member for a railway vehicle wherein said vehicle comprises a pair of relatively movable components and said wear member is supported by one of said components and protects said components from wear during relative movement thereof and said wear member comprises; a metal support having a planar supporting portion; a polymeric material having an antifriction wear surface engageable by said other component; and means attaching said polymeric material to said metal support and supporting same against said planar supporting portion, said attaching means comprising a metal structure fixed to said planar supporting portion, said metal structure having openings therein which receive said polymeric material therethrough which serves as a matrix for said metal structure, and said metal structure serving to reinforce said polymeric material and prevent cold flow thereof; the improvement wherein said support has an integral holding portion initially extending coplanar with said planar portion and with said holding portion being adapted to be bent transverse said planar portion, said holding portion having been finally bent transverse said planar portion and against said one component with said relatively movable components substantially in assembled relation to hold said wear member against a particular movement relative to said one component.

9. In a coupler carrier wear member for a railway vehicle wherein said vehicle comprises a coupler assembly and a coupler carrier which are relatively movable and said coupler carrier wear member is supported by said coupler carrier and protects said coupler assembly and said coupler carrier from wear during relative movement thereof and said wear member comprises; a metal support having a planar supporting portion provided with a pair of opposite side edges and a holding leg extending perpendicular to one of said side edges, said holding leg being adapted to engage said coupler carrier to hold said wear member against movement in one direction; a polymeric material defining an antifriction wear surface engageable by said coupler assembly; and means attaching said polymeric material to said metal support and supporting same against said planar supporting portion, said attaching means comprising a metal structure fixed to said planar supporting portion, said metal structure having openings therein which receive said polymeric material therethrough which serves as a matrix for said metal structure, and said metal structure serving to reinforce said polymeric material and prevent cold flow thereof; the improvement comprising an extension initially extending from the other of said side edges coplanar with said planar supporting portion and with said extension being adapted to be bent transverse said planar supporting portion, said extension having been finally bent against said coupler carrier with said coupler assembly and coupler carrier substantially in assembled relation to hold said wear member against movement in a direction opposite from said one direction.

* * * * *